US006089777A

United States Patent [19]

Wong

[11] Patent Number: 6,089,777

[45] Date of Patent: Jul. 18, 2000

[54] TAB DIVIDER SHEET ASSEMBLY

[75] Inventor: Galen C. Wong, Pasadena, Calif.

[73] Assignee: Avery Dennison Corporation, Pasadena, Calif.

[21] Appl. No.: 09/360,706

[22] Filed: Jul. 26, 1999

[51] Int. Cl.[7] ..... B42F 13/00

[52] U.S. Cl. ..... 402/79; 281/39; 40/354; 40/641

[58] Field of Search ..... 402/79, 80 R; 281/38, 39; 40/354, 641; 283/36–42, 61, 62

[56] References Cited

U.S. PATENT DOCUMENTS

| | | | |
|---|---|---|---|
| 3,924,744 | 12/1975 | Heimann . | |
| 4,560,600 | 12/1985 | Yellin et al. . | |
| 4,962,603 | 10/1990 | Kao et al. . | |
| 5,135,261 | 8/1992 | Cusack et al. . | |
| 5,182,152 | 1/1993 | Ericson | 428/42 |
| 5,558,454 | 9/1996 | Owen . | |
| 5,662,976 | 9/1997 | Popat et al. . | |
| 5,743,566 | 4/1998 | Hunter et al. . | |
| 5,792,297 | 8/1998 | Hunter et al. . | |
| 5,836,710 | 11/1998 | Owen . | |
| 5,909,979 | 6/1999 | Winzen | 402/79 |
| 5,924,812 | 7/1999 | Goldman | 402/79 |
| 5,954,445 | 9/1999 | Deutschmann et al. | 402/79 |
| 5,966,852 | 10/1999 | Drzewiecki | 402/79 |
| 5,996,130 | 12/1999 | Verhines | 40/359 |
| 6,004,062 | 12/1999 | Hunter et al. | 402/79 |
| 6,032,984 | 3/2000 | Ishida | 283/70 |

FOREIGN PATENT DOCUMENTS

| | | |
|---|---|---|
| WO 97/32737 | 9/1997 | WIPO . |
| WO 98/07582 | 2/1998 | WIPO . |
| WO 98/21051 | 5/1998 | WIPO . |
| WO 98/41406 | 9/1998 | WIPO . |
| WO 99/22359 | 5/1999 | WIPO . |

*Primary Examiner*—Andrea L. Pitts
*Assistant Examiner*—Alisa L. Thurston
*Attorney, Agent, or Firm*—Oppenhiemer Wolff & Donnelly LLP

[57] ABSTRACT

An index divider sheet assembly including a divider sheet having a tab on a sheet edge and a strip removably attached to the divider sheet and extending out from the sheet edge. A printable strip has a first strip portion attached to and flat on a first face of the tab and a second strip portion separated from the first strip portion by a fold line. The assembly is fed into a printer or copier with the second strip portion releasably secured to and flat on the removable strip. The printer or copier prints (mirror-image) indicia on the first and second strip portions. After this printing operation, the removable strip is manually removed from the sheet and from the second strip portion. The second strip portion is then folded backward on the fold line and secured with its adhesive to the opposite second face of the tab.

31 Claims, 9 Drawing Sheets

TAB DIVIDER SHEET ASSEMBLY

BACKGROUND OF THE INVENTION

The present invention is directed to index sheets that are directly printable by machines such as laser or ink jet printers. More specifically, it relates to constructions of index divider sheet assemblies, processes of manufacturing them and methods of using them.

A popular index divider product that is printable by laser printers is the "DIRECT PRINT Custom Dividers for Laser Printers" product, which has been available from Avery Dennison Corporation of Pasadena, Calif. since 1998. It has an index tab extending out from a tab edge thereof and an opposite binding edge flap, which is calendered and folded over onto the adjacent calendered portion of the body sheet and held down with a releasable adhesive. By folding the flap over and tacking it down, the effective width of the product is reduced so that it can be fed into today's printers or copiers.

An adhesive peel-off strip is adhered to the backside of the sheet along the tab edge and behind the tab of the DIRECT PRINT product. Thereby, the strip defines a straight edge perimeter for the product, improving feeding of the product into and/or passing of the product through a printer or copier. The strip is then peeled off of the sheet after the printing operation and disposed of. This product is disclosed in U.S. Pat. No. 5,743,566 ('566) (Hunter et al.) and U.S. Pat. No. 5,792,297 ('297) (Hunter et al.). See also, U.S. Pat. No. 5,558,454 (Owen) and U.S. Pat. No. 5,836,710 (Owen). (These four patents and all other patents and other publications and applications mentioned anywhere in this disclosure are hereby incorporated by reference in their entireties.) Additionally, see PCT Publications WO 98/07582 and 98/41406, both by ACCO USA, Inc.; another user printable tab sheet construction is disclosed in PCT publication WO 99/22359; and other index sheets are disclosed in U.S. Pat. No. 3,924,744 (Hiemann), U.S. Pat. No. 4,560,600 (Yellin) et al.), U.S. Pat. No. 4,962,603 (Kao et al.) and U.S. Pat. No. 5,135,261 (Cusack et al.) and wO 97/32736 (ACCO USA, Inc.).

The DIRECT PRINT product can thereby be fed in a portrait direction into laser printers, and the peel-off strip creates a rectangular sheet article which provides a continuous edge to run through the printer. When it is fed into tabloid-size laser or ink jet printers that are designed to print eleven inch by seventeen inch sheets in a landscape orientation, it is fed binding edge first. This insures proper feeding because if it were fed peel-off strip edge first, the tab edge may catch in the printer.

For some of the tabloid-size laser printers when the product is fed in the landscape direction and peel-off strip last, the peel-off strip helps the printer correctly sense the edge of the sheet. That is, without the strip the edge of the sheet would be sensed about one half inch early, and once the sensor is triggered the printer does not print, and thus will not print on the tab. Examples of these printers are the HP 4V, 5SI and the Mopier printers from HP.

The peel-off strip of the DIRECT PRINT product passes behind the entire back face of the tab. Thus, with the strip on for improved feeding and printing, indicia cannot be printed by the printer or copier on the back face of the tab, only on the front face of the tab. However, sometimes it is desirable to print indicia (particularly the same indicia) on both faces of the tab.

One way to print on both faces is to use the variation on the DIRECT PRINT product shown in FIG. 15 of the '566 patent.

That embodiment includes in addition to the folded-over binding edge, two short peel-off strips, releasably attached to the back of the index sheet at opposite ends of the tab, and spaced apart with the tab in between them. Thereby the back of the tab is not covered by either peel-off strip and is exposed for a printing operation thereon. The sheet is then passed twice through the printer or copier, one time to print indicia on the front of the tab and the other time to print on the back. In other words, the sheets would be printed, recollated to put them in the correct printing order, printed again, the peel-off strip removed and the binding edge unfolded.

A very recently commercialized version of the DIRECT PRINT product is called "DIRECT PRINT Custom Dividers For Ink Jet Printers" and is especially adapted for ink jet printers. The feed trays of these printers have corner separation tabs or clips. To prevent the folded-over flaps of these new products from catching on these tabs, both ends of the flaps have cut-out corners. These new products, and variations thereon and manufacturing methods therefor are disclosed in copending applications Serial Nos. 09/310,499 and 09/310,503, both filed on May 12, 1999.

SUMMARY OF THE INVENTION

Disclosed herein is an index divider sheet assembly which even with its outwardly extending tab can be effectively fed into and printed thereon by a printer or copier and which can be printed on both sides of its tab in a single pass through the printer or copier. The assembly, like the DIRECT PRINT product, preferably has a peel-off strip attached with releasable adhesive to a back side of the tabbed sheet, extending out from the tabbed edge and passing behind the tab. The strip thereby forms a straight edge of the assembly along the tabbed edge.

The assembly includes a film strip (or other piece of material) having first and second film portions, both of which are similarly shaped and preferably are separated from one another by a score or other fold line. The first film portion is adhered to the front face of the tab (similar to the DIRECT PRINT product), and the second film portion extends out from the tab and onto the peel-off strip and is attached to the front face of the peel-off strip with pressure sensitive adhesive. The assembly is passed once through a printer or copier, and indicia is printed in this single pass on both film portions. The film portions have toner receptive or ink jet receptive coatings to effectively receive and accept the printing.

After this single-pass printing, the peel-off strip is removed from (peeled off) the sheet and the second film portion is removed from the peel-off strip. To provide a clean, easy and consistent removal of the second film portion, the peel-off strip preferably has a silicone release coating on its front side where the second film portion attaches. The (indicia-printed) second film portion is folded backward on the fold line and adhered with (its) adhesive to the back side of the tab. Thereby the desired indicia is effectively printed on both sides of the tab, with only a single pass of the assembly through the printer or copier.

Although the present invention preferably uses (or even requires) a printer or copier that is capable of printing eleven inch wide paper (which is referred to as landscape-fed), the divider sheet itself does not need to be fed eleven inch wide. The dimensions of the entire divider assembly can be ten inch by eleven inch. Thus, the assembly can be fed ten inch wide, though this is not the preferred method.

A preferred process of manufacturing the above-discussed index divider sheet assembly secures a first portion of a film patch to one face of a sheet with the second portion folded around a sheet edge and onto the other face of the sheet. The sheet and patch are then cut to form a sheet tab with the first and second portions having their shapes conforming to that of the tab. The second portion is unfolded and adhesive is applied to the back side of the tab and/or back side of the second portion. The peel-off strip is then adhered to the back side of the sheet and the second portion is attached with the adhesive to the front side of the strip.

A first alternative manufacturing process of the invention applies a peel-off strip to the back of an untabbed sheet. A film patch is applied to the paper at the desired tab location, extending over and onto the peel-off strip. The paper and film patch are then die cut to form the tab and the first and second patch portions.

Pursuant to a second alternative manufacturing process the sheet is tab cut and then the peel-off strip is applied. A patch with the shaped first and second portions is provided. The first portion is secured in position to the tab and the second portion is attached to the adjacent peel-off strip.

Examples of (performance-based) definitions of terms used herein to describe adhesives which attach a first member (sheet, strip, film, label, etc.) to a second member (substrate, sheet, etc.) are now discussed. A "permanent" adhesive attaches to the substrate with high tack within zero to eight hours and cannot be removed without damage to the first or second members. A first member attached with a "removable" adhesive can be removed without damage to the substrate and with little or no damage to the first member or adhesive residue for a practically-long period of six months to a couple of years following application. On the other hand, first members attached with "ultra-removable" adhesives exhibit long-term (indefinite) removability from a wide variety of second members (substrates). They leave essentially no residue and can be reapplied.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
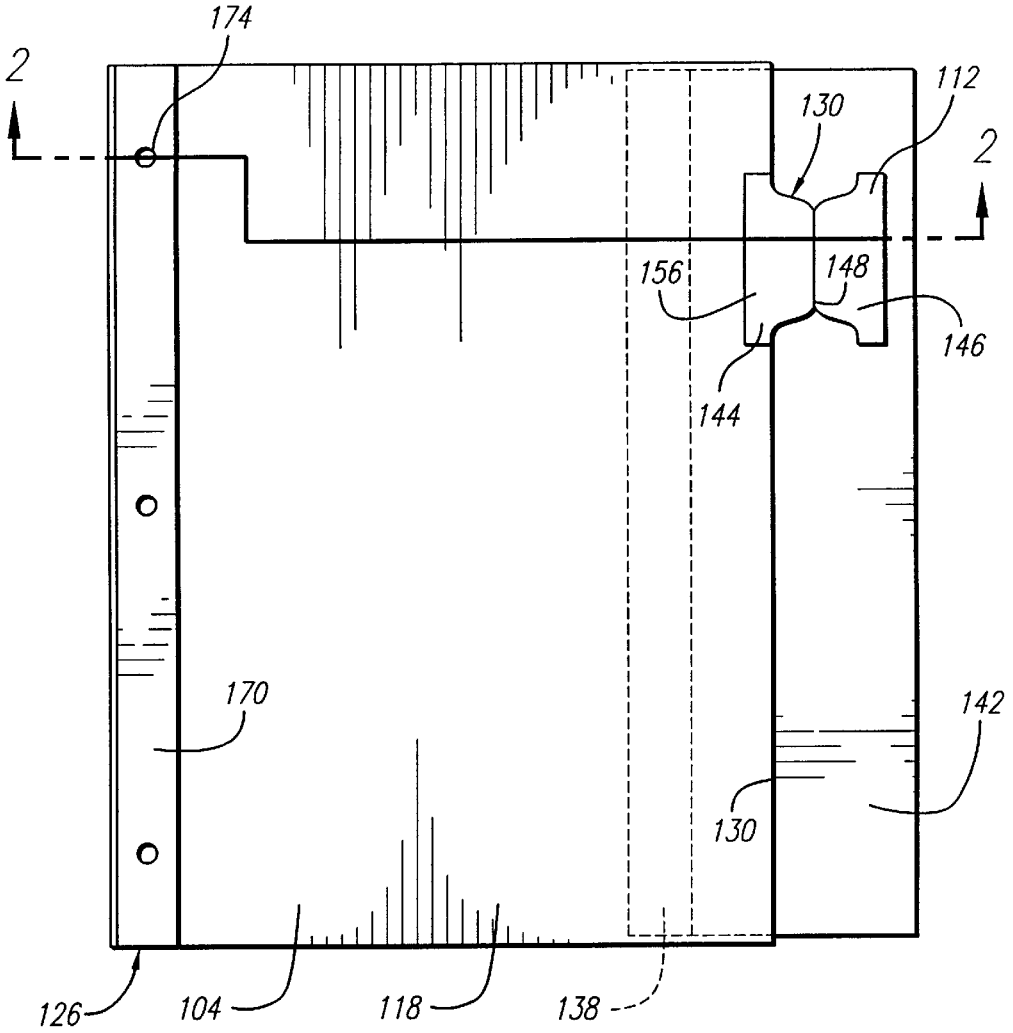
FIG. 1 is a front view of an index divider sheet assembly of the present invention.
Figure 2:
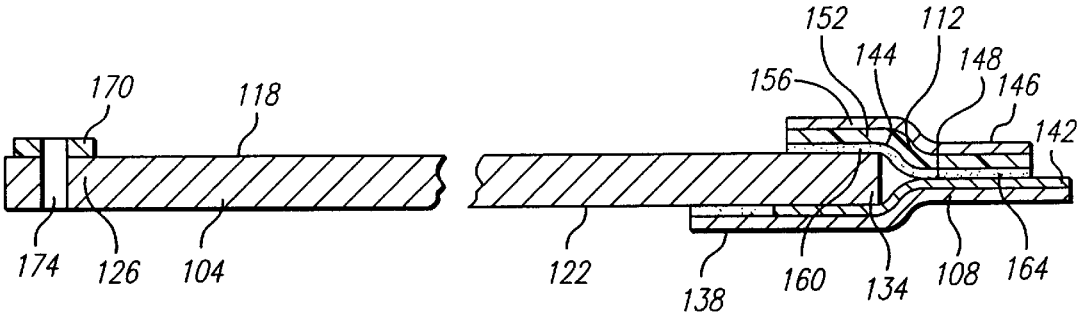
FIG. 2 is an enlarged cross-sectional view taken on line 2—2 of FIG. 1.

Referring to FIGS. 1 and 2, an index divider sheet assembly of the present invention is illustrated generally at 100, ready for feeding into a printer or copier. Assembly 100 includes an index divider sheet 104, a peel-off strip 108, and a film strip 112. The sheet 104 has a front face 118, a back face 122, a binding edge region 126, a tab edge 130 and a tab 134 extending out from the tab edge. The peel-off strip 108 has on a front face thereof an adhesive strip 138 and a release coating 142, in side-by-side lanes. The peel-off strip 108 is attached to the back face 122 of the sheet 104 via the adhesive strip 138 and extends out the tab edge 130 and out beyond the outer edge of the tab 134 and the strip 112. Thereby it defines a straight edge of the assembly 100 for reasons similar to those discussed in the '566 and '297 patents to improve feed of the sheet 104 into a printer or copier, passage therethrough and/or printing on the sheet.

The film strip 112 has mirror-image first and second strip portions 144 and 146, preferably separated by a fold line 148. The film strip 112 comprises a film 152 coated with a toner-receptive or ink jet receptive coating 156, as shown in FIG. 2.

This coating 156 can be those available from Precision Coatings (PCI) for laser printing and from Arkwright (348 Universal Ink Jet coating) for ink jet printing. The first strip portion 144 is secured to the front face of the tab 134 with an adhesive layer 160, and the second strip portion 146 is secured to the peel-off strip 108, or more specifically on the silicone release coating 142 thereof, with an adhesive layer 164.

A reinforcing strip 170 can be applied to the front face 118 (or the back face 122) of the sheet along the binding region 126, which can be calendered to compensate for the thickness of the strip. The reinforcing strip 170 can be a nylon or polyester film (such as the 2.0 mil thick film available from KT Industries) and can be applied with a high temperature heat-activated adhesive. The reinforcing strip 170 reinforces the ring holes 174 in a known manner. However, assembly 100 (or sheet 104) can be adapted for binding systems not using ring holes 174. For example, it can be used for comb binding, thermal binding and/or velobinding systems. The reinforcing strip 170 would be helpful for all of the systems except for the thermal binding, though its presence for that system would not be adverse. Where assemblies 100 for a number of different binding systems are to be produced, the reinforcing strip 170 can be provided on all of the assemblies for manufacturing consistency with some of the assemblies including ring holes 174 and others not including them.

Figure 7:
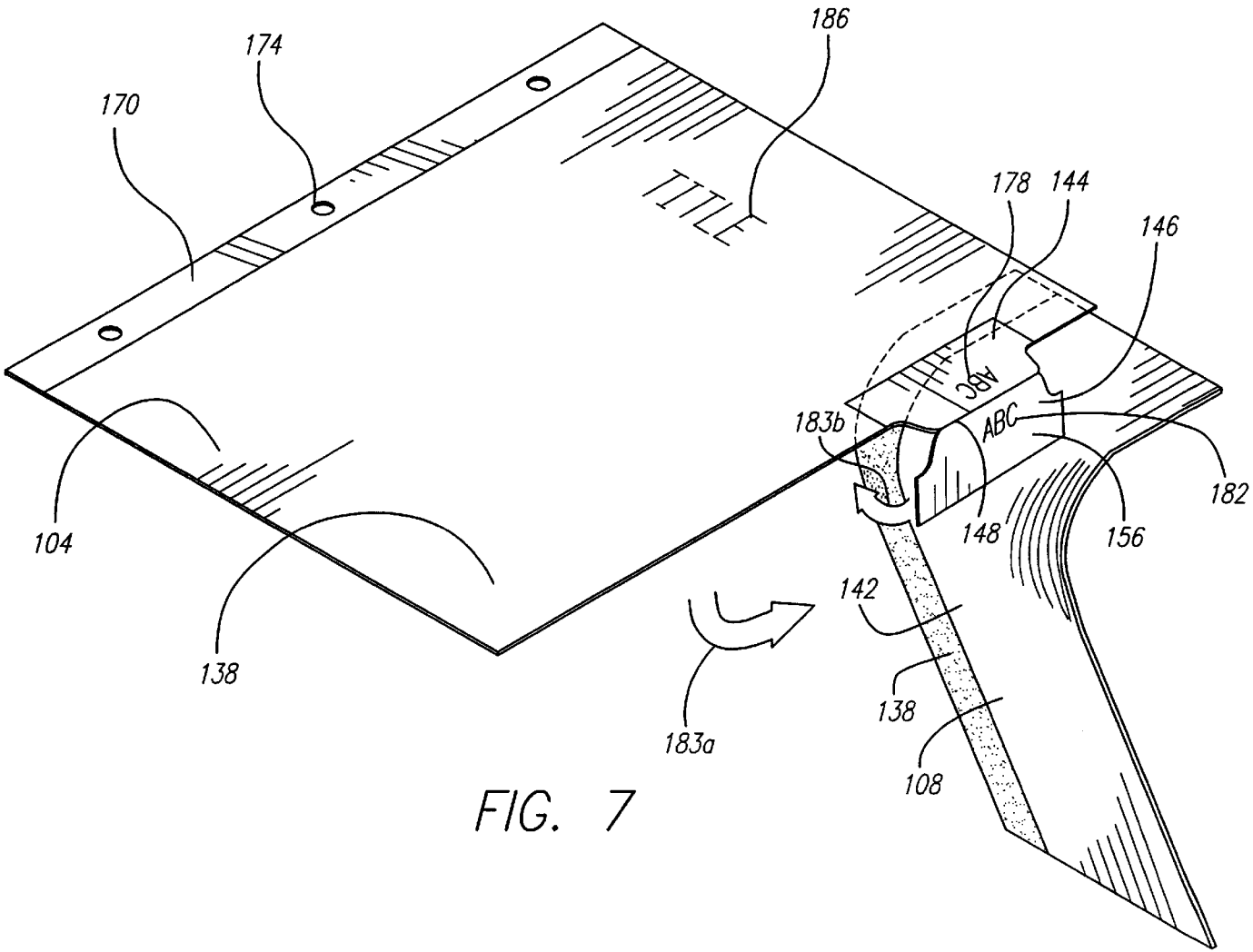
FIG. 7 is a front perspective view of the assembly of FIG. 1 after a printing operation thereon and showing the removal of the peel-off strip and the repositioning of the printed tab film thereof.

Referring to FIG. 7, assembly 100 can be fed using an automatic feed tray into a printer or copier and mirror-image indicia 178, 182 printed on the first and second strip portions 144, 146, respectively. More specifically, the indicia 178, 182 are printed directly on the receptive coating 156. The assembly 100 can be fed into the printer or copier in the landscape direction (the eleven inch direction), with the peel-off strip 108 defining the trailing edge. Printers capable of printing media that is eleven inches wide include network laser printers (HP LaserJet 4V, LaserJet 5si, and HP Mopiers, Mopier 240 or 320, LaserJet 8000 and 8100, Color LaserJet 8500), copiers and some ink jet printers (HP DeskJet 1100C). Additional indicia 186 as desired can be printed directly on the body portion of the sheet 104.

The printed assembly 100 is removed from the outfeed tray of the printer or copier, the peel-off strip 108 is peeled off the back face 122 of the sheet 104 as shown by arrow 183*a* and off of the back of the second strip portion 146 as shown by arrow 183*b*. The second strip portion 146 is folded on fold line 148 and secured with the adhesive layer 164 to the back face of the tab 134. Thereby with only a single pass through the printer or copier, indicia 178, 182 is effectively printed on both faces of the tab 134. With printing on both the front and back of the tab 134 and the index divider sheet 104 assembled with other sheets and papers in a document (such as in a binder or the like), the user can easily and quickly identify indexed sections of the document regardless of their location in the document.

Figure 10:
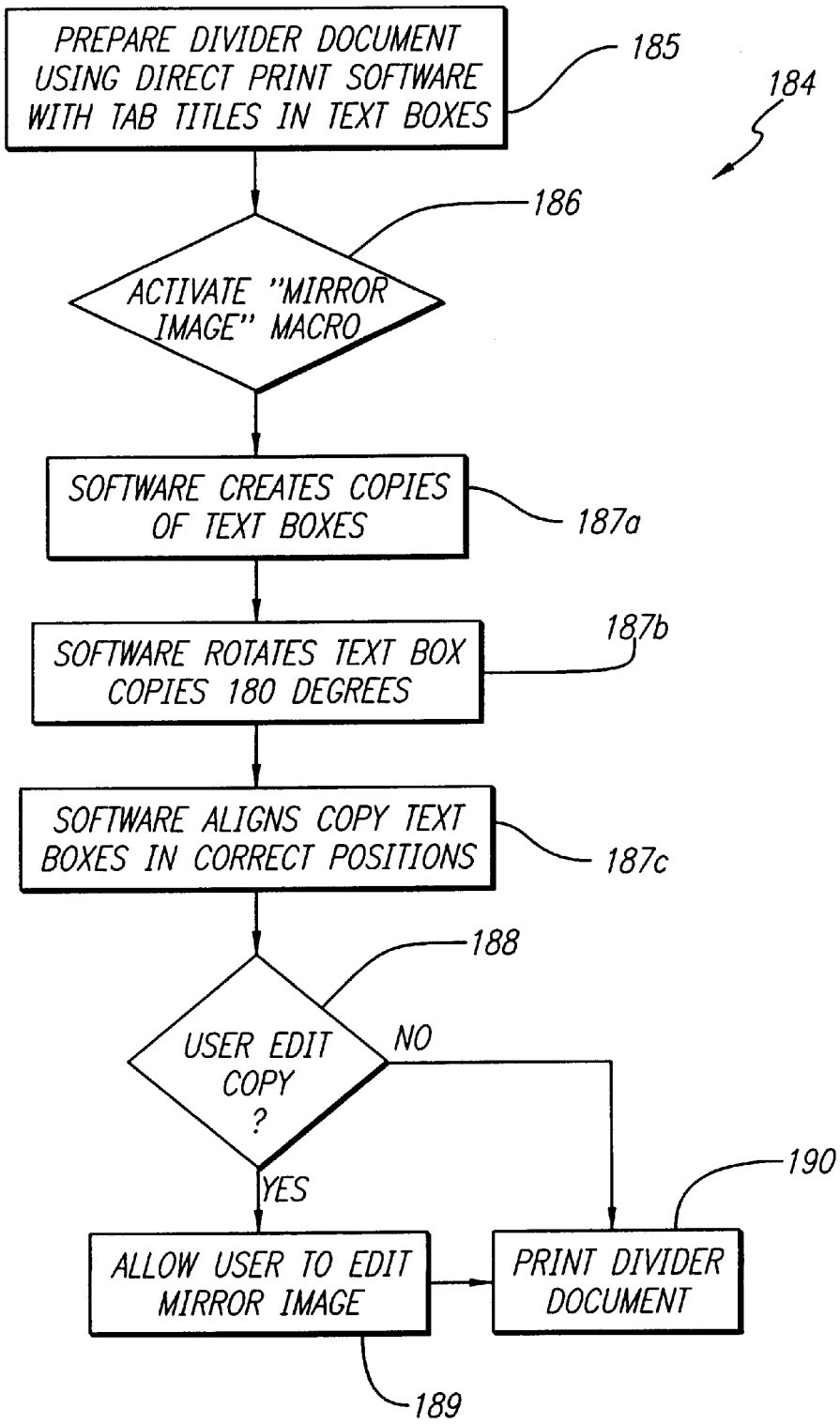
FIG. 10 is a flowchart showing a process for creating the mirror-image indicia on the opposite strip portions of the index divider sheet assembly.

A flowchart for producing the mirror-image indicia 178, 182 is set forth in FIG. 10 generally at 184. The process starts with a layout of the index divider sheet assemblies 100 exactly like the current software macro commercially provided with the previously-described DIRECT PRINT product, except that the page size will be larger to accommodate the extra page width, as shown by step 185. The steps specific to the invention are now described. The software macro is activated as shown by step 186 and creates a copy of each text box in the tab area, as depicted in step 187*a*. In the MS WORD example, this is done by selecting the text box and choosing the copy and paste commands in the toolbar (the macro would do this automatically). The text in the text box copy is rotated by the macro using standard word processing rotation commands, as shown in step 187*b*. Pursuant to step 187*c*, the macro positions the box copy to the correct location opposite the corresponding tab position. The user has the option of editing the text in the copied box (step 188) pursuant to process 184. While the user may want the back side of the tab to be printed with different information (step 189), the default text would be identical to the face side. Finally, the user prints the document onto the dividers and tabs, as illustrated in step 190.

The index divider sheet 104 can be a standard size nine-by-eleven inch tabbed divider sheet (eight-and-a-half inches wide with a tab 134, which extends about one-half inch out from the tab edge 130). The body and the tab of the sheet are made from a single integral sheet of paper. The paper of the sheet 104 can have generally any desired finish (smooth to vellum). And the paper can have a caliper or thickness between three and twelve mils. The paper can have a basis weight from seventy-five to two hundred grams per square meter, and preferably 90# index basis weight. This advantageously is a heavier paper than the paper used for the above-discussed DIRECT PRINT products because the folded-over binding edge flap is not used. (However, an alternative assembly of the present invention as shown generally at 192 in FIG. 8 includes a folded-over binding edge flap 194.) The peel-off strip 108 comprises a strip 20# bond paper base, approximately two-and-a-half inches or two-and-three-eighths inches wide and eleven inches long. The strip 108 has a thickness of between 2.0 mils and 4.0 mils, and a preferred thickness in the range of 2.75 to 3.00 mils. The adhesive strip 138 is about three-quarter or five-eighths inch wide, extends the length of the peel-off strip 108 and is an ultraremovable adhesive such as the FASSON CLEAN-TAC I adhesive. The release coating 156 coats the adjacent portion of the top face of the peel-off strip 108 and is preferably a silicone release coating or similar release agent. There can be a narrow empty lane on the paper between the adhesive strip 138 and the release coating 142 in practice.

The film 152 of the film strip is preferably a MYLAR film, or other durable material (preferably some type of plastic) and preferably coatable with the receptive coating 156. (See U.S. Pat. No. 5,662,976 to Popat et al.) The thickness of the film 152 can range between 0.75 (75 gauge) to 3.00 mils, with 2.00 mils preferred. The adhesive layers 160 and 164 are preferably a heat-activated adhesive or a pressure sensitive adhesive (PSA). Examples of usable adhesives are hot melt rubber-based adhesives (such as AVERY P-902), permanent solvent-based acrylic adhesives (such as AVERY P-9) and acrylic emulsion adhesives (such as AVERY S-490 and P-49). The PSA layer 164 during the feeding and printing step(s) attaches the second strip portion 146 to the peel-off strip 108, on the release coating 156, and the release coating allows the second strip portion 146 to be subsequently released from the peel-off strip, as shown in FIG. 7 by arrow 183*b*.

An alternative embodiment does not include the release coating 156. Rather, the adhesive of layer 164 can be an ultraremovable or removable adhesive in which case the second strip portion 146 would be releasably adhered. And an improvement to this alternative coats the backside of the second strip portion 146 with a coating that aggressively adheres to the ultraremovable adhesive. This coating can be made at the same time as the heat-activated coating is applied to the MYLAR film roll.

Figure 3A:
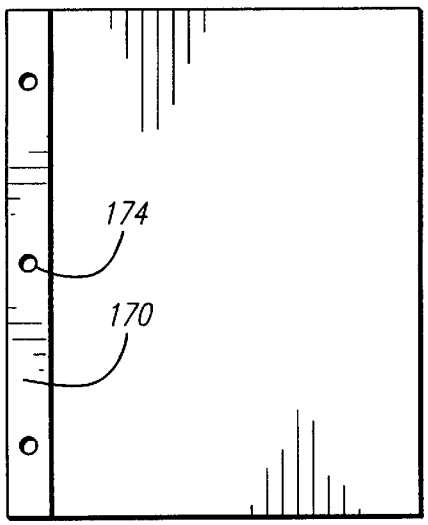
FIGS. 3*a*–3*g* are elevational views showing sequential steps of manufacturing an index divider sheet assembly pursuant to a preferred process of the present invention.
Figure 3B:
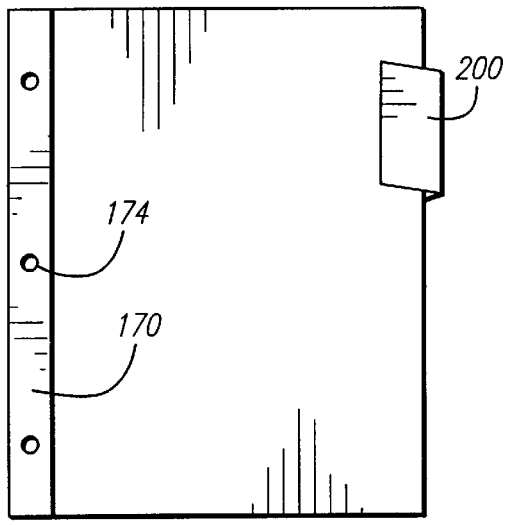
Figure 3C:
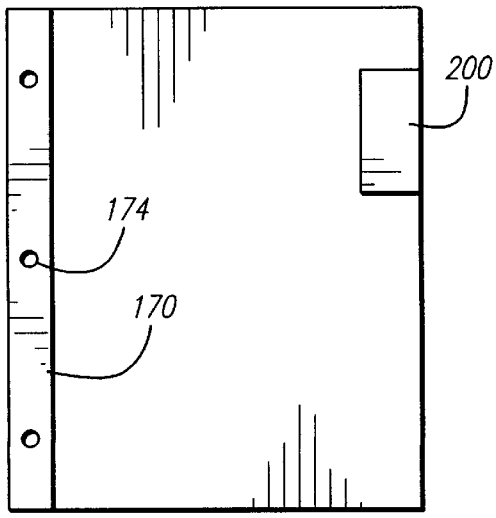
Figure 3D:
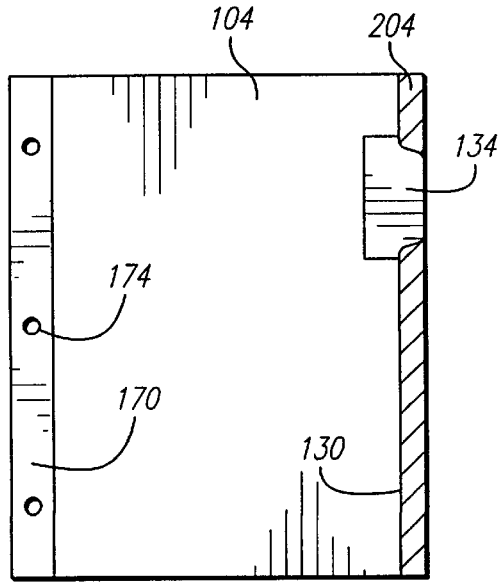
Figure 3E:
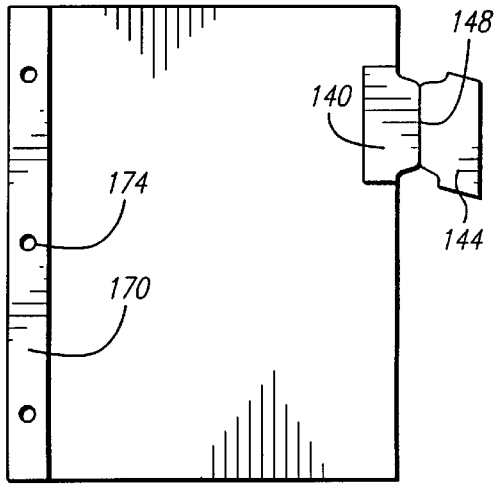

Sequential steps of a preferred process for manufacturing assembly 100 are illustrated in FIGS. 3*a*–3*g*. FIG. 3*a* shows a paper sheet from a 9.25 inch roll. The paper is reinforced with the reinforcing strip 170, the ring holes 174 are punched and the paper is slit to a nine inch width. A MYLAR film patch 200 is cut and folded, and heat-activated adhesive (layer 160) is applied to the back of the front half but not the back half. The sheet in FIG. 3*a* is fed into the "V" shaped patch 200, as illustrated in FIG. 3*b*, and the MYLAR patch 200 is clamped down and sealed, as depicted in FIG. 3*c*. The sheet is tabcut using a standard tabcutter, such as the Scott Ten Thousand or ARC, and the cutaway portion as shown by reference numeral 204 in FIG. 3*d* is removed, to form the tab (134). In other words, FIGS. 3*a*–3*e* illustrate the following steps: the MYLAR patch 200 is cut from a roll in about two-and-a-half inch long pieces and folded into a V-shape and held in place; a nine-by-eleven inch sheet is fed into the folded patch 200 so that the patch is positioned where the tab (134) is to be; the patch 200 is clamped down upon by heated plates, which seal the patch to the paper; only one-half of the patch has adhesive and the other half is clean. The left and right sides of the paper are simultaneously cut away, leaving the reinforced tab; and the second strip portion 144 is then unfolded, as depicted in FIG. 3*e*.

Figure 3F:
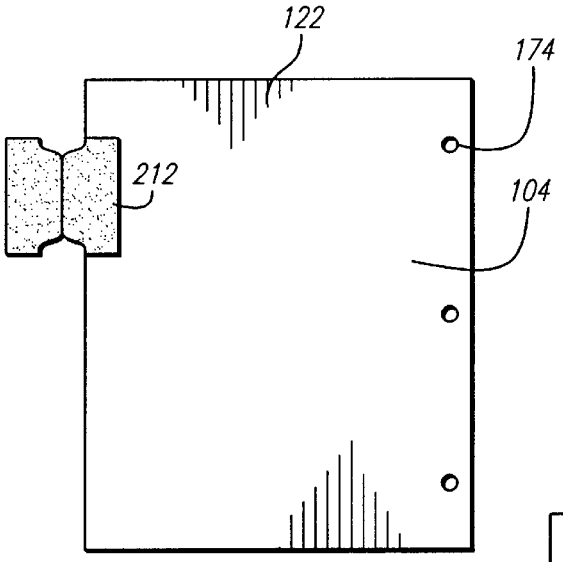
Figure 3G:
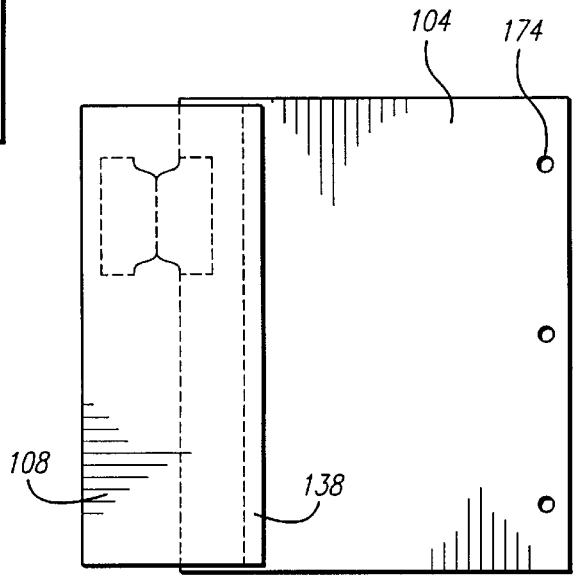

The assembly 208 as illustrated in FIG. 3*e* includes the first strip portion 140 adhered to the underlying tab (134) thereby formed and the unadhered second strip portion 144 extends out from the first strip portion 140, with a fold (score) line 148 separating them. FIG. 3*f* shows the backside of assembly 208 with hot melt pressure sensitive adhesive (PSA) 212 applied using an adhesive printing process on the back of the tab 134. A light adhesive coating (adhesive layer 174) is also applied on the back of the second strip portion 144. Functionally, however, adhesive needs to be applied to only one of the surfaces, either the back of the second strip portion 144 or the back of the tab 134. Thus, the preferred methods of this process are to apply the adhesive only on the back of the strip portion or on both back surfaces. However, it is also within the scope of the invention to apply the adhesive only to the back side of the tab.

A peel-off strip 108 having the adhesive strip 138 and silicone release coating 142 is then applied to the back of the assembly (illustrated in FIG. 3*f*). The adhesive strip 138 releasably holds the peel-off strip 108 to the back of the sheet 104. Since the adhesive layer 174 (and the adhesive 212) is (are) attached on the release coating 142, the second strip portion 144 is held releasably on the peel-off strip 108, for subsequent removal as shown by arrow 183*b* in FIG. 7.

Figure 4A:
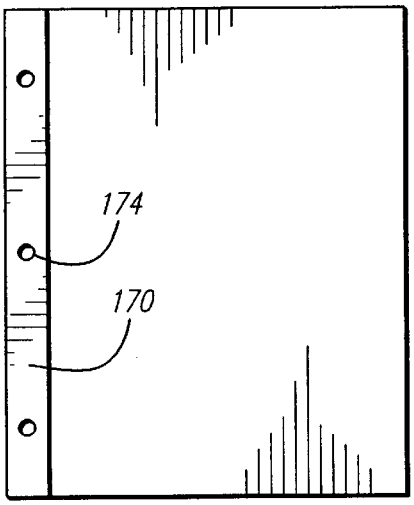
FIGS. 4*a*–4*d* are elevational showing sequential steps of manufacturing an index divider sheet assembly pursuant to a first alternative process.
Figure 4B:
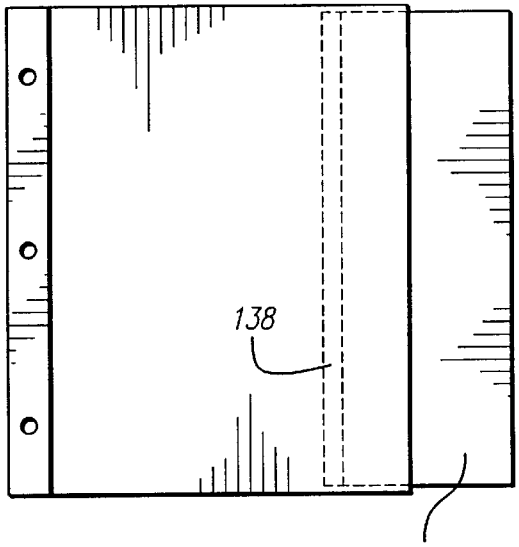
Figure 4C:
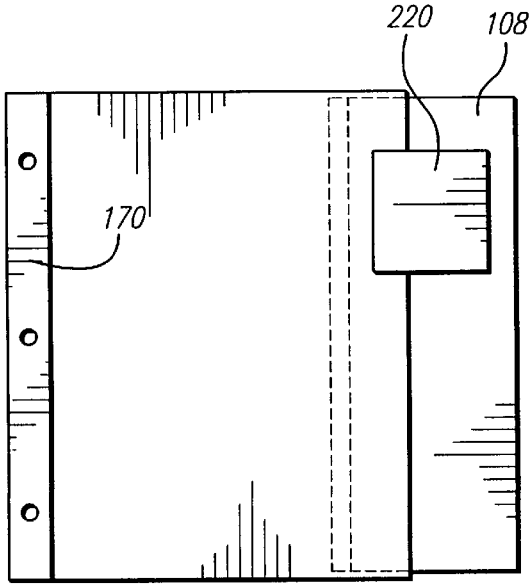
Figure 4D:
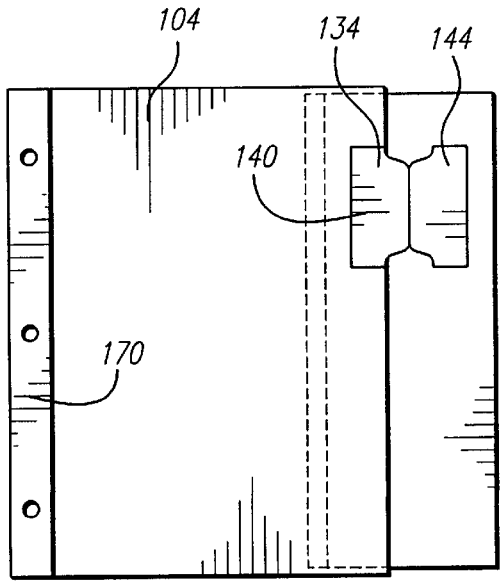

Steps of a first alternative manufacturing process of assembly 100 are illustrated in FIGS. 4*a*–4*d*. FIG. 4*a* shows a sheet reinforced with strip 170 and punched with ring holes 174. A peel-off strip 108 is applied to the back of the sheet using the adhesive strip 138, as depicted in FIG. 4*b*. Referring to FIG. 4*c*, a rectangular patch 220 of PSA-coated MYLAR film is applied to the paper and to the peel-off strip 108 at the desired location for the tab (134). The paper and the patch 220 are then die cut to form the tab (134), and the first and second strip portions 140, 144. The tab 134 and film strip portions 140, 144 are cut simultaneous in one rotary die cutting operation, similar to "kiss-cutting" labels so as to not cut through the peel-off strip 108. The extraneous strips of paper and film are then removed by vacuum or air pressure/mechanical systems to form the assembly depicted in FIG. 4*d*.

The scored fold line (148) may not be provided pursuant to the first alternative process and the below-discussed second alternative process. However, a variation thereon would make the score line by including it on the rotary die. That is, as the rest of the material is cut, the die would also add a score through the top of the MYLAR film.

Figure 5A:
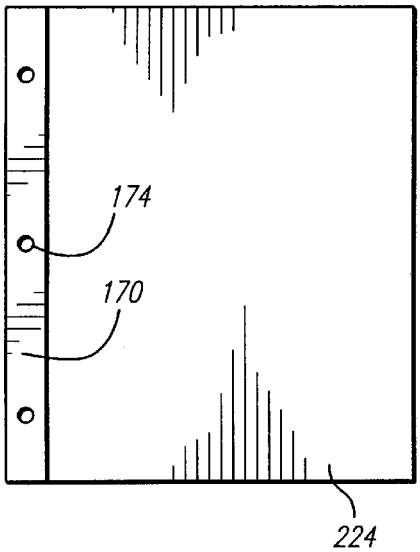
FIGS. 5*a*–5*d* are elevational views showing sequential manufacturing steps of an index divider sheet assembly pursuant to a second alternative process.
Figure 5B:
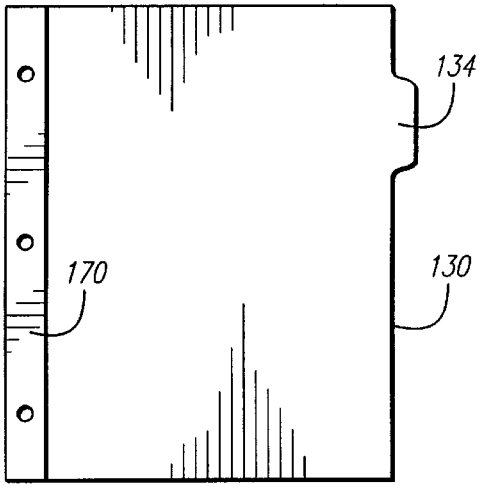
Figure 5C:
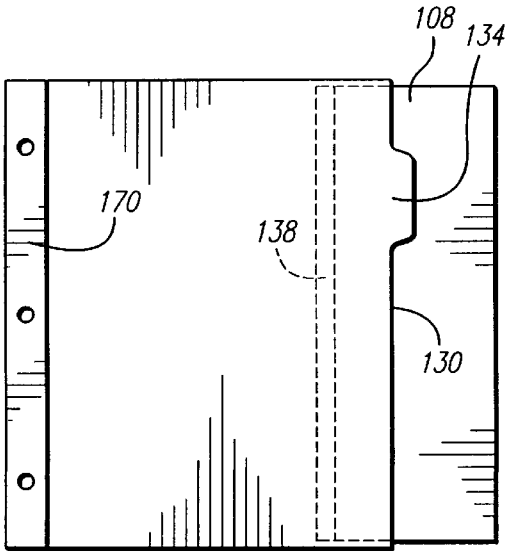
Figure 5D:
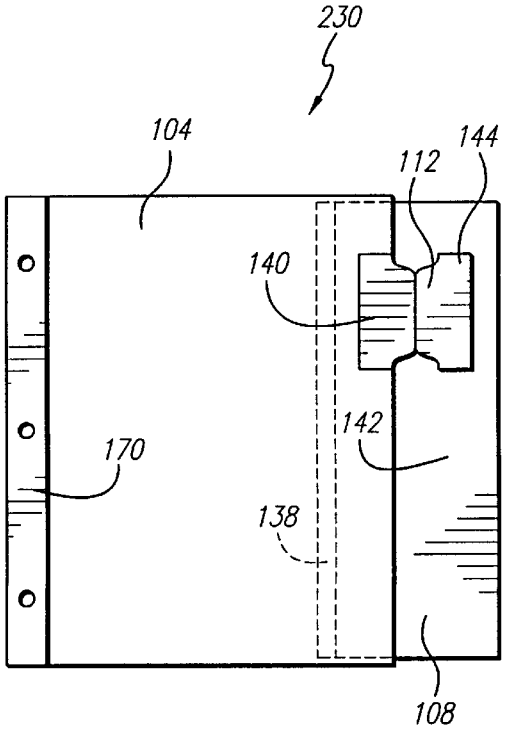

Steps of a second alternative manufacturing process of the invention are shown in FIGS. 5*a*–5*d*. FIG. 5*a* is similar to FIG. 4*a*, discussed above. The sheet 224 of FIG. 5*a* is then tab cut using a standard tabcutter, such as the Scott Ten Thousand or the ARC, to form tab 134. The peel-off strip 108 is applied via the ultraremovable adhesive strip 138 to the back of the sheet, extending out beyond the tab edge 130 as shown by assembly 230 in FIG. 5*c*. The release coating 142, as described previously, covers the face of the peel-off strip 108 except for the area of the adhesive strip 138. Film strip 112, which is pre-cut to form first and second strip portions 140, 144, is applied to assembly 230 via the adhesive layers (160, 164). The first strip portion 140 is applied directly on top of the tab, and the second strip portion 144 extends out therefrom onto the peel-off strip 108.

The alternative processes illustrated in FIGS. 4*a* and 5*a* differ further from that of the preferred process of FIG. 3*a* in that the divider sheets are not sheeted from the paper roll until after all of the peel-off strip 108 and MYLAR film strip application and die cutting steps. In other words, sheeting is the last step, and results in the peel-off strip 108 being exactly the eleven inch (or other desired) length of the sheet 104.

For the three above-discussed manufacturing processes, all sheeting and edge reinforcing can be done on a standard printing press like the SuperWeb. All tabcutting can be done on a Scott Ten Thousand or an ARC tab cutter. Peel-off strip application and hot melt adhesive coating (of the second alternate) can be done on the GaVehren fold-and-glue machine. A hot-melt adhesive printing station would be added for the adhesive coating step.

In the first alternate process, this can all occur on a press like the SuperWeb in a continuous web and sheeted at the end. The peel-off strip material would be adhered to the hole-punched, hole-reinforced paper web. The MYLAR "patch" can be applied in-line by a mechanism that cuts the correct length of MYLAR and applies the patch to the paper/peel-off strip web. The last step would be die cutting of the tab shape through the cardstock and MYLAR, without cutting through the peel-off strip. The leftover "pieces" can be removed by a vacuum system or mechanically. Finally, the divider sheets would be sheeted off of the web at eleven inch intervals.

Figure 6A:
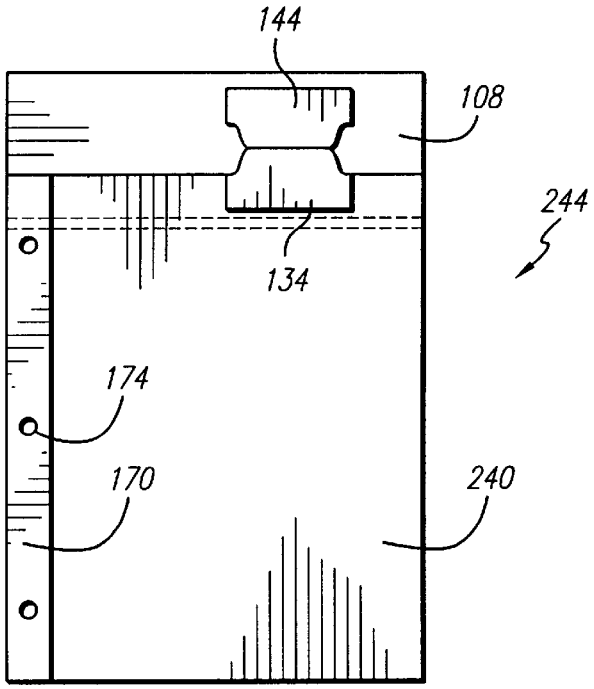
FIG. 6*a* is a front elevational view of a top-tab index divider sheet assembly of the present invention.
Figure 6B:
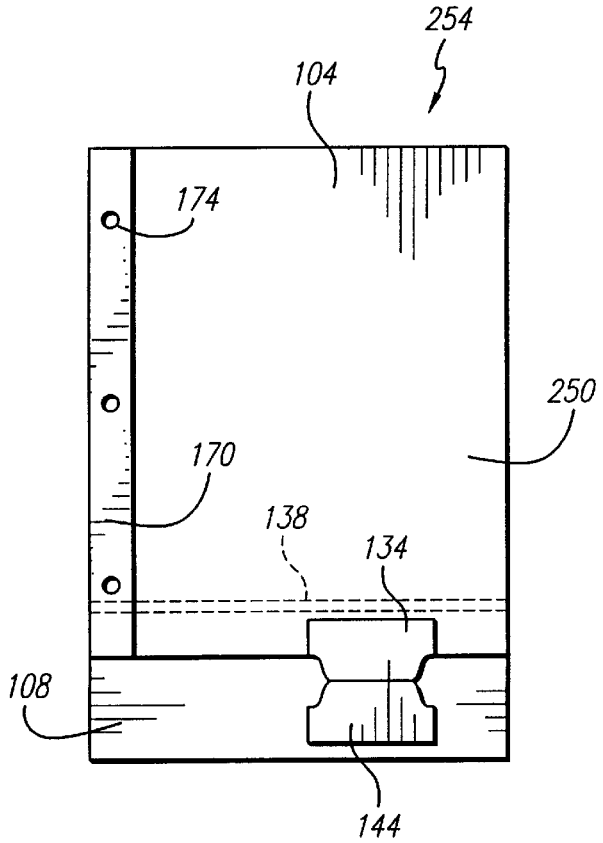
FIG. 6*b* is a front elevational of a bottom-tab index divider sheet assembly of the present invention.

Assembly 100, as depicted in FIG. 1, has the tab 134 positioned on the long side of the sheet 104 opposite to the binding edge region 126. However, it is also within the scope of the invention to position the tab 134 at either end of the sheet 104. These alternatives extend the invention to all laser printers, copiers, ink jet printers capable of printing on legal size paper. The peel-off strip 108 would then also be positioned at that end to square-off or provide a straight edge at the tab extension end. However, instead of having a length of eleven inches, the peel-off strip 108 would have a length of eight-and-a-half inches (or nine inches), the same as the width of the sheet 104, or slightly shorter. The tab 134 can be at the top edge of the sheet 240 pursuant to the index divider sheet assembly shown generally at 244 in FIG. 6*a*. Alternatively, the tab 134 can be at the bottom edge of the sheet 250 pursuant to the index divider sheet assembly shown generally at 254 in FIG. 6*b*.

Since the lengths of the sheets 240, 250 would be greater than eleven inches, assemblies 244, 254 would preferably be fed into the printer or copier in the portrait direction (the eight-and-a-half inch wide direction). Being too long, the assemblies 244, 254 could not be fed into generally any of today's printers or copiers in the landscape direction, unless the sheets 240, 250 were made shorter. Shorter sheets, however, may not be aesthetically acceptable to consumers. Preferably, the peel-off strip would be at the trailing edge of the assembly 244, 254 when fed into the printer or copier. However, the peel-off strip could be the lead-in end if the assemblies 244, 254 would not thereby get caught on the printer's feed mechanisms.

The previously-discussed DIRECT PRINT products include a folded-over binding edge which reduces the effective width of the product to allow for the additional product width provided by the tab and the peel-off strip, so that the product can be fed into printers or copiers for effective printing operations thereon. Preferred embodiments of the index divider sheet assemblies of this invention do not include a folded-over binding edge. This has a number of advantages. First, user assembly is easier since the binding edge does not need to be unfolded after the printing operation. Second, the effective printing area on the body of the sheet is increased since the binding edge is not folded over onto it during the printing operation. Third, a heavier, sturdier paper can be used for the divider sheet since there is no folded-over portion restricting the paper thickness for feeding into the printer or copier.

Figure 8:
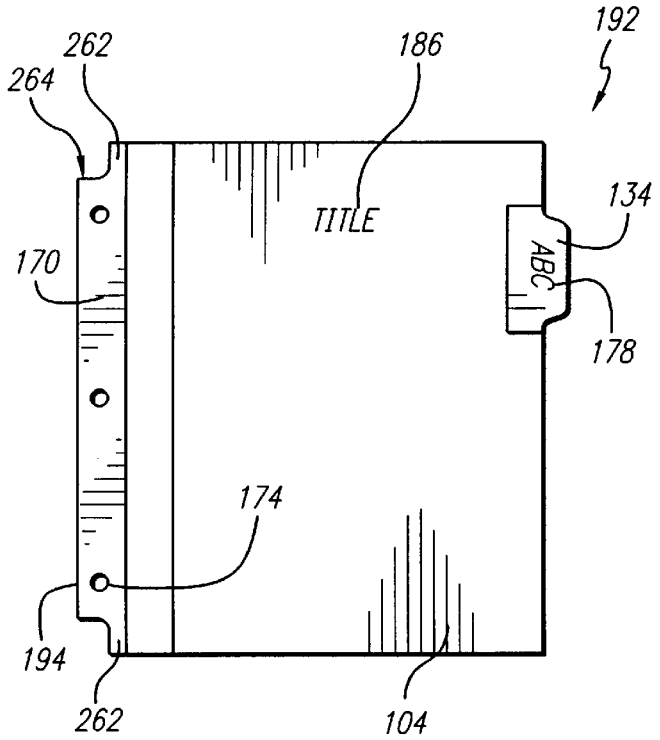
FIG. 8 is a front perspective view of an alternative assembly of the present invention after a printing operation, peel-off strip removal and printed tab film repositioning, and showing the unfolding of the binding edge flap.

Further to the discussion of the paragraph above, it is also within the scope of the present invention for the assembly to include a fold-over flap, as shown for example by assembly 192 and flap 194 in FIG. 8. The flap 194 can include end notch cuts 260, such as provided in the DIRECT PRINT Custom Dividers for Ink Jet Printers product discussed earlier, to define narrow legs 262. However, the notch cuts would not be needed where the printer or copier is capable of printing eleven inch wide paper, since the multipurpose (special media) trays do not have the separation clips. FIG. 8 shows the assembly after the printing operation thereon, the removal of the peel-off strip and the folding over and attachment of the printed second film portion. Arrow 264 shows the motion of the flap 194 being unfolded after the printing operation.

Figure 9:
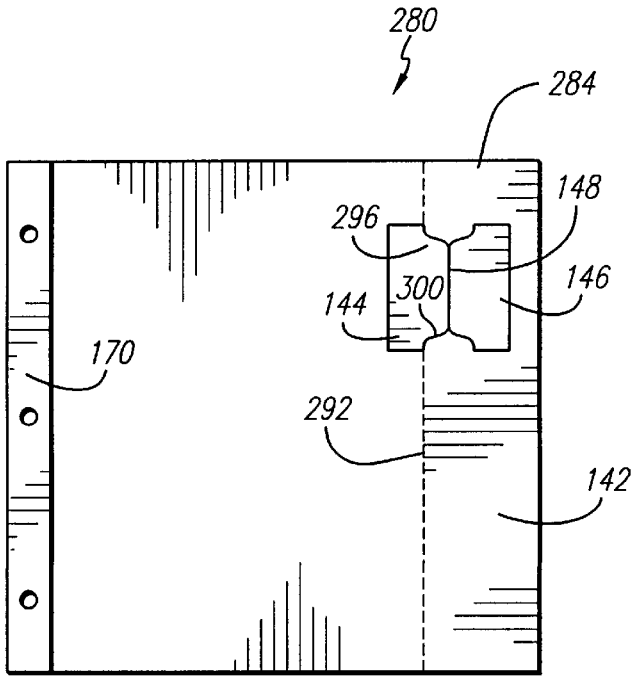
FIG. 9 is a front elevational view, similar to FIG. 1, showing a tear-off strip alternative assembly embodiment of the present invention.

A further alternative index divider sheet assembly of the present invention is shown generally at 280 in FIG. 9. As illustrated therein, the removable strip is a tear-off strip 284. That is, instead of being attached with an adhesive strip (134) to the back of a peel-off strip (108), it is formed from the same paper web or sheet as the index divider sheet 288. A microperforation line 292 is formed to separate the strip 284 from the sheet 288 and thereby define the perimeter of the tab 296 and the tab edge 300. The first and second strip portions 144 and 146 would need to be precisely applied to the tab 196 and the strip 284, similar to the process step illustrated in FIG. 5*d*. The adhesive layer (164) attaching the second strip portion 146 to the strip 284 is preferably a permanent adhesive in which case a release coating 142 should first be applied to the strip 284. Thus, after the printing operation, the strip 284 is torn off (along the microperforation line 292) instead of being peeled off of the sheet.

The cuts of the microperforation line 292 can vary in size from 0.0125 to 0.0135 inch, separated by ties that vary in size from 0.0045 to 0.0050 inch, so that there are between fifty-three and fifty-nine perforations per inch, with about fifty-six perforations being an average therebetween. Alternatively, the perforations are at least fifty per inch, or in the range of thirty-five to fifty-nine perforations per inch. A further alternative is for the perforation line 292 to have larger cut-and-tie configurations, such as very large cuts (two to three inches or so) with small ties in between (about 1/32"–1/16"). However, the preferred line would be the microperforations.

From the foregoing detailed description, it will be evident that there are a number of changes, adaptations and modifications of the present invention which come within the province of those skilled in the art. However, it is intended that all such variations not departing from the spirit of the invention be considered as within the scope thereof.

What is claimed is:

1. A tabbed divider sheet assembly, comprising:

a divider sheet having a sheet edge, a sheet first face and an opposite sheet second face;

a tab attached to the sheet and extending out from the edge, the tab having a tab first face and an opposite tab second face;

a removable strip removably attached to the divider sheet and extending out from the sheet edge; and a printable strip having a first strip portion attached to the tab first face and a second strip portion releasably attached to the removable strip.

2. The assembly of claim 1 wherein the printable strip includes a fold line separating the first and second strip portions.

3. The assembly of claim 2 wherein after the removable strip has been separated from the divider sheet and the second strip portion has been released from the removable strip, the second strip portion is foldable on the fold line and then attachable to the tab second face.

4. The assembly of claim 3 further comprising adhesive means for attaching the second strip portion to the tab second face.

5. The assembly of claim 1 wherein the second strip portion includes a layer of adhesive which adheres the second strip portion to the tab second face after having been released from the removable strip.

6. The assembly of claim 1 wherein the divider sheet has a binding edge.

7. The assembly of claim 6 wherein the binding edge includes binder ring holes through the divider sheet.

8. The assembly of claim 7 further comprising a reinforcing strip positioned on the divider sheet to reinforce the binder ring holes.

9. The assembly of claim 1 wherein the printable strip comprises a printable lamination film printable thereon by a printer or copier.

10. The assembly of claim 1 wherein the removable strip includes a release coating at the second strip portion.

11. The assembly of claim 1 further comprising pressure sensitive adhesive on a back side of the second strip portion.

12. The assembly of claim 1 further comprising ultraremovable adhesive attaching the removable strip to the second side of the sheet.

13. The assembly of claim 1 wherein the printable strip is configured with a narrow waist separating the first and second strip portions.

14. The assembly of claim 13 wherein the printable strip includes a score line extending across the narrow waist.

15. The assembly of claim 1 wherein the sheet includes a binding edge opposite to the sheet edge, the binding edge defining a landscape-feed lead-edge of the assembly, and the removable strip defines a trailing edge for landscape-feeding the assembly into a printer or copier.

16. The assembly of claim 1 wherein the divider sheet and tab comprise a continuous sheet of the same material.

17. The assembly of claim 1 further comprising a microperforation line separating the removable strip from the divider sheet.

18. The assembly of claim 17 wherein the microperforation line defines the sheet edge and a perimeter of the tab.

19. The assembly of claim 18 wherein the divider sheet, the tab and the removable strip together comprise a continuous sheet of the same material and further comprising a release coating on the removable strip and adhesive means for adhering the second strip portion to the removable strip on the release coating and after the removable strip has been removed from the divider sheet for affixing the second strip portion to the tab second face.

20. A tabbed divider sheet assembly, comprising:

a divider sheet having a sheet edge, a sheet first face and an opposite sheet second face;

a tab attached to the sheet and extending out from the edge, the tab having a tab first face and an opposite tab second face;

a printable strip having a first strip portion attached to the tab first face and a second strip portion; and securing means for securing the second strip portion to the tab second face after the assembly has passed through a printer or copier and indicia has been printed on the first and second strip portions.

21. The assembly of claim 21 wherein the printable strip includes a fold line separating the first and second strip portions.

22. The assembly of claim 21 wherein the securing means includes a pressure sensitive adhesive.

23. The assembly of claim 21 further comprising a removable strip attached to the divider sheet, the second strip portion when the assembly is passed through the printer or copier being releasably secured to a face of the removable strip.

24. The assembly of claim 21 wherein the first and second strip portions lie flat and in the same plane when the assembly is fed into the printer or copier.

25. A tabbed divider sheet assembly, comprising:

a divider sheet having a sheet edge, a tab extending out from the sheet edge, a sheet first face and a sheet second face;

a strip releasably attached to the sheet second face, behind the tab and extending out from the sheet edge;

a release coating on a portion of the strip;

a film having first and second similarly-shaped film portions, which are separated by a fold line;

a toner or ink jet receptive coating on the film portions;

the first film portion being secured to the tab on the sheet first face; and the second film portion being attached to the strip on the release coating.

26. The assembly of claim 25 wherein the second film it portion is releasably attached to the strip such that after the assembly has passed through a printer or copier and indicia printed on the film portions, the second film portion can be peeled off of the strip, the strip peeled off of the sheet, and the second film portion folded on the fold line and secured to the tab on the sheet second face.

27. The assembly of claim 25 wherein the sheet includes a binding edge and the sheet edge is opposite to the binding edge.

28. The assembly of claim 27 wherein the sheet includes binding edge holes and a reinforcement strip for the holes.

29. The assembly of claim 25 wherein the sheet includes a binding edge and the sheet edge is adjacent and perpendicular to the binding edge.

30. The assembly of claim 29 wherein the sheet includes binding edge holes and a reinforcement strip for the holes.

31. The assembly of claim 25 further comprising a folded-over flap along a binding edge of the sheet.

* * * * *